United States Patent [19]

Hiraoka

[11] 4,451,222

[45] May 29, 1984

[54] APPARATUS FOR PRODUCING CONCRETE PIPES

[76] Inventor: Kunizo Hiraoka, 202-5, 2-chome, Higashi, Onari-cho, Omiya-shi, Saitama, Japan

[21] Appl. No.: 391,448

[22] Filed: Jun. 23, 1982

[30] Foreign Application Priority Data

Jun. 23, 1981 [JP] Japan ..... 56-98084

[51] Int. Cl.[3] ..... B28B 21/22

[52] U.S. Cl. ..... 425/432; 425/435

[58] Field of Search ..... 425/435, 432; 264/70, 264/71, 310, 311

[56] References Cited

U.S. PATENT DOCUMENTS

| | | | |
|---|---|---|---|
| 2,703,916 | 3/1955 | Butler | 425/485 X |
| 3,098,764 | 7/1963 | Kao | 425/435 X |
| 3,304,591 | 2/1967 | Housmonn | 425/435 X |
| 4,311,632 | 1/1982 | Hiraoka | 264/40.5 |

*Primary Examiner*—Thomas P. Pavelko

*Attorney, Agent, or Firm*—Wenderoth, Lind & Ponack

[57] ABSTRACT

An improved apparatus for producing concrete pipes includes a molding box and a pair of runner wheels for supporting the molding box. The box is vibrated while being rotated to disperse the components of ballast uniformly with sand and cement interposed therebetween. This apparatus makes it possible to produce concrete pipes having a higher strength.

2 Claims, 6 Drawing Figures

APPARATUS FOR PRODUCING CONCRETE PIPES

BACKGROUND OF THE INVENTION

1. Field of the Invention

The invention relates to an apparatus for producing various sorts of concrete pipes, and particularly to an apparatus for producing concrete pipes of stiff-consistency concrete by use of a press roller.

2. Description of the Prior Art

Hume pipes are commonly known as pipes made of concrete. Hume pipes are produced by supplying watery and fluid concrete into a molding box, the molding box being rotated at high speed, thereby molding the concrete through centrifugal force.

However, when watery concrete is molded, a large amount of water flows out during the molding. The water, if discharged into rivers as it stands, will give rise to a problem of industrial pollution. Since it is necessary to treat the waste water by providing a sewage treatment plant, large sums for operation costs and equipment expenses are required. In addition, since part of the cement flows out together with water, the waste of material constitutes one major factor in raising the price of the products.

With a view to overcoming the difficulties involved in the production of Hume concrete pipes and drastically improving the strength thereof, the applicant has proposed a method for producing concrete pipes by use of stiff-consistency concrete (U.S. Pat. No. 4,311,632).

If pipes are produced by use of stiff-consistency concrete, there is no flow-out of water during the molding operation. Thus, not only the sewage treatment can be omitted but also there is no waste of cement, so that concrete pipes having a high strength can be made at low price.

The concrete (A) for producing Hume concrete pipes is prepared by mixing ballast (B), sand, water, etc. with cement.

Thus, when the concrete is molded through centrifugal force in the molding box by imparting rotation thereto, the ballast (B) having a greater weight collects adjacent its outer periphery so that components of the ballast (B) will be brought into contact with each other as shown in FIG. 1.

In such a condition, because there is no cement or sand existing between said components, coherence between the components of the ballast (B) decreases, resulting in the reduction in strength of the concrete (A).

The concrete pipe in which the components of the ballast (B) are brought into contact with each other has a disadvantage in that a crack can start from the part where the components contact each other.

The aforedescribed difficulty can be overcome by suitably spacing the components of the ballast (B) with cement and sand interposed therebetween so that the components are securely bound to each other, as shown in FIG. 2. However, according to the conventional method for producing Hume concrete pipes by use of a pressing roller, it was completely impossible to obtain such a concrete layer as described hereinabove for the improvement of the strength of the concrete pipe.

SUMMARY AND OBJECTS OF THE INVENTION

An object of the present invention is to provide an apparatus for producing concrete pipes having a greater strength by imparting rotation and shocks to the molding box containing concrete, thereby interposing cement and sand between the components of the ballast.

According to the invention, rotation is imparted to runner wheels horizontally supporting the molding box by means of drive means, the wheels being vertically moved by a vibration generating unit so that they are vibrated vertically, thereby interposing cement and sand between the components of the ballast of the concrete.

BRIEF DESCRIPTION OF THE DRAWINGS

Other objects and features of the present invention will become apparent from the following description taken with reference to the accompanying drawings in which.

Figure 3:
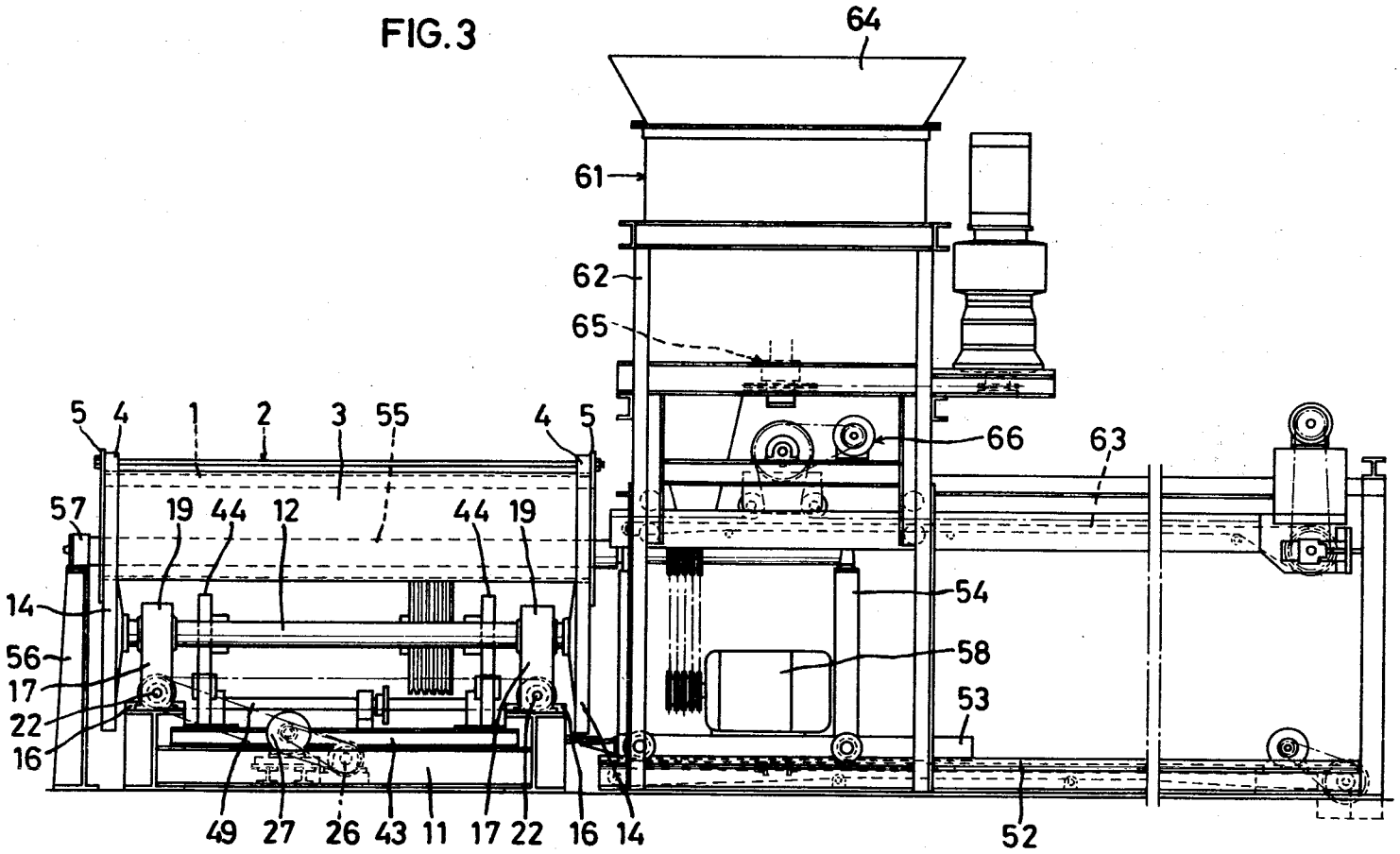
FIG. 3 is a front view of the apparatus according to the present invention.

Referring to the drawings and in particular to FIG. 3, the molding box 2 for molding a concrete pipe 1 comprises a tubular body 3, tires 4 and annular rings 5 for forming the end faces of the pipe 1 provided on the opposed ends of the tubular body 3. In case of the preferred embodiment, the molding box 2 is adopted to mold a straight pipe. The molding box 2 may be provided with a socket at one end thereof or may be divisible into two parts for easy release of the concrete pipe formed. The tubular body 3 may have a tapering inner face.

The apparatus of this invention for producing a concrete pipe 1 by use of said molding box 2 having a smooth outer surface is adapted to impart rotation and vibrations to the horizontally supported molding box 2, while imparting pressure to the concrete pipe from the inner periphery thereof.

Figure 4:
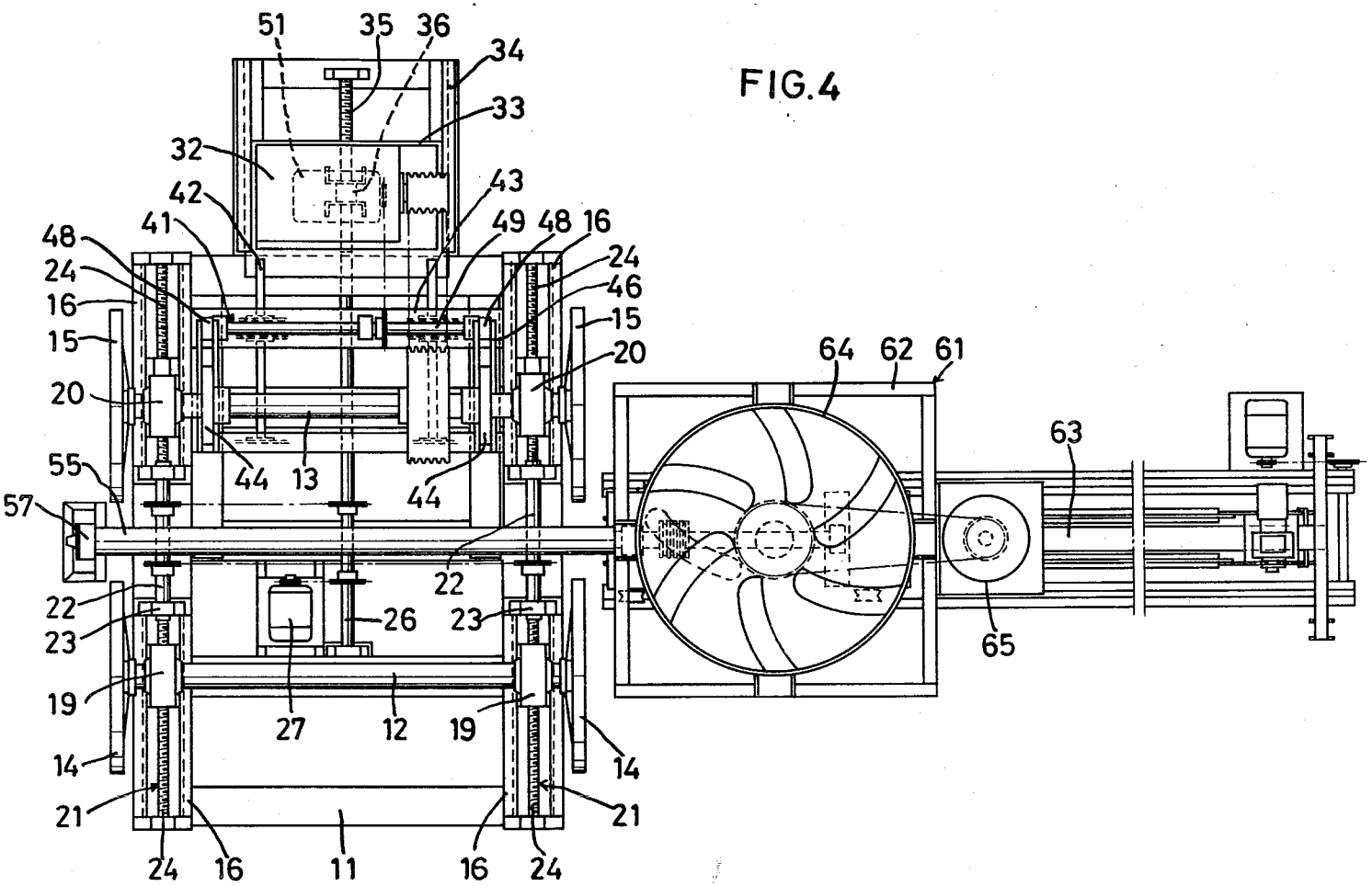
FIG. 4 is a plan view thereof.

A pair of rotary shafts 12, 13, best shown in FIG. 4, are horizontally juxtaposed on a base frame 11 of the apparatus, a single pair of runner wheels 14, 15 having smooth outer surfaces and being secured to the opposite ends of the rotary shafts 12, 13 so as to support the tires 4 shown in FIG. 3.

Figure 5:
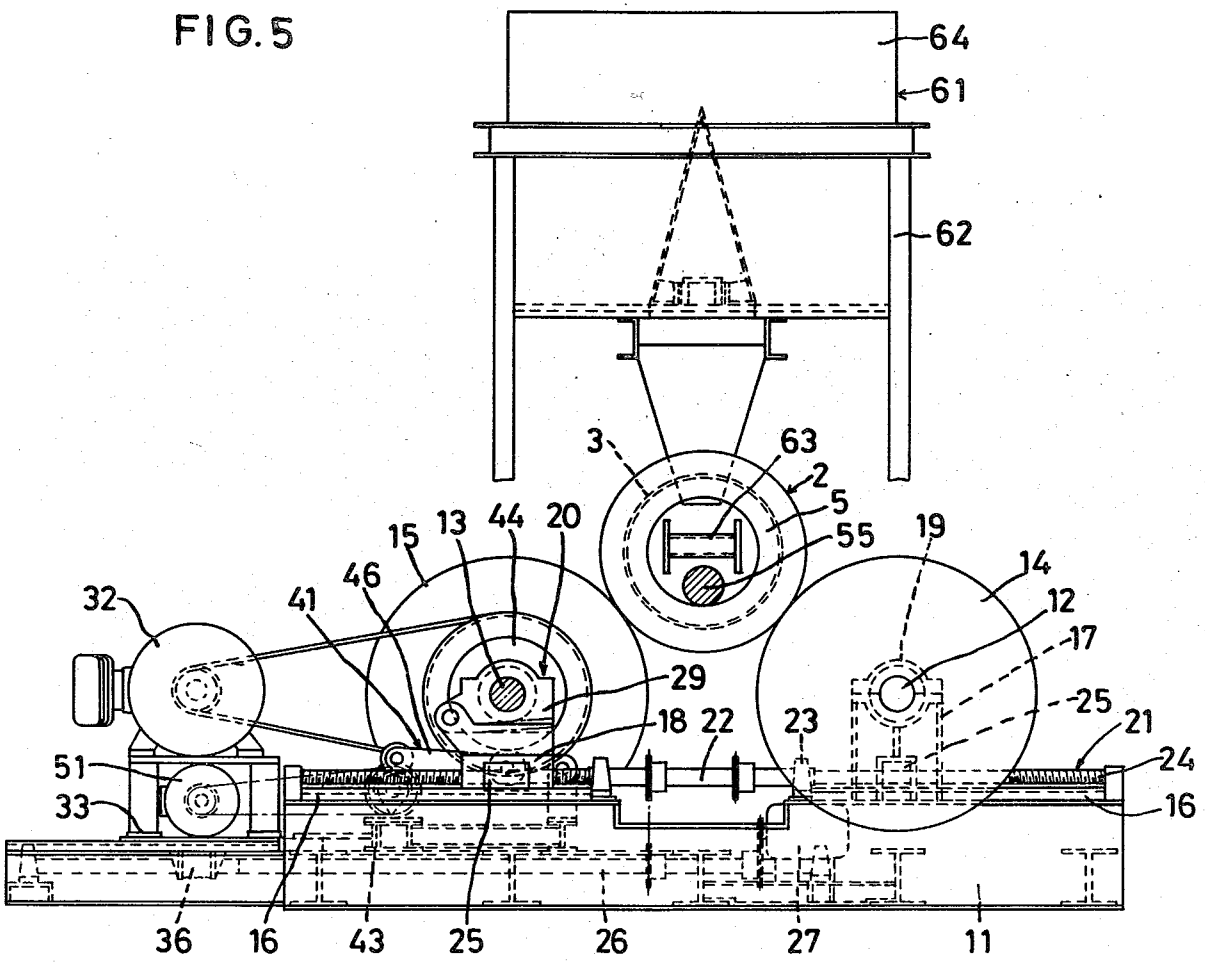
FIG. 5 is a vertical sectional view thereof.

As best seen in FIG. 5, rotary shafts 12, 13 are rotatably supported at both ends thereof by bearings 19, 20 of carriages 17, 18 movable along guides 16 provided normally with respect to the rotary shafts 12, 13 on the base frame 11. The carriages 17, 18 at both ends are interlocked by feed screw units 21 so as to be brought toward and away from each other.

As shown in FIG. 4, screw shafts 22 of said feed screw unit 21 are supported by bearings 23 provided on the base frame 11 so as to be located above the guides 16, respectively. As seen in FIG. 5 male threads 24 at equal pitch are formed on the guides 16 at both ends, nuts 25 on the carriages 17, 18 engaging with the male threads 24, respectively.

In the center of the lower part of the base frame 11 there is provided a center shaft 26 in parallel with the screw shafts 22, 22, the center shaft 26 being driven by a motor 27 mounted on the base frame 11, said center shaft 26 being coupled to one of the screw shafts 22 through endless chains and sprockets, both screw shafts 22, 22 being interlocked in the same manner.

When the motor 27 is driven, both screw shafts 22, 22 are rotated in synchronization, each pair of runner wheels 14, 15 being brought toward and away from each other while being kept parallel, thereby changing the spacing therebetween, for example, from that for a 400 mm dia. molding box to that for a 1500 mm dia. molding box.

The adjustment of the spacing between the runner wheels 14, 15 is effected according to the change in the diameter of the molding box 2 so that the angle made by the lines connecting the centers of the rotary shafts 12, 13 and the center of the molding box 2 is maintained at the fixed value. Then, the frictional force between the tire 4, shown only in FIG. 3, and the runner wheel 15 of FIGS. 4 and 5 is optimum, thereby imparting rotation of the molding box 2 of FIGS. 3 and 5 through the runner wheels 15 smoothly, regardless of the diameter of the molding box 2.

Figure 6:
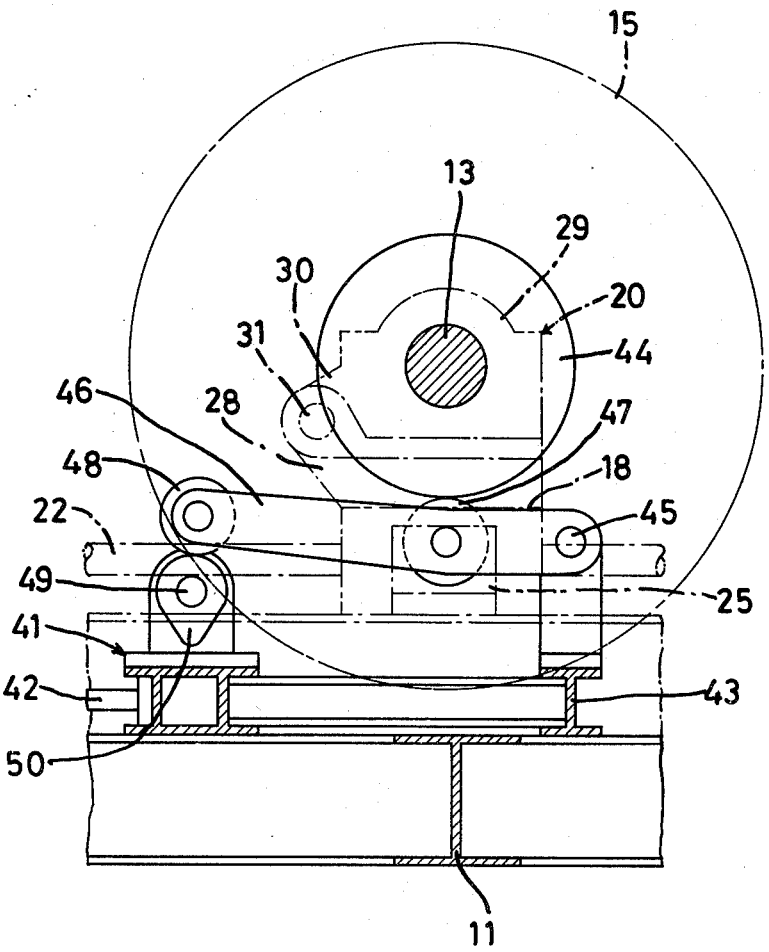
FIG. 6 is an enlarged vertical sectional view of the vibration generating mechanism.

Referring to FIG. 6, the bearing 20 supporting each end of the rotary shaft 13 on the left side has a supporter 28 erected on one side of the upper face of the carriage 18. A mounting piece 30 is provided on the lower side of a bearing body 29 and is pivotally fixed to the supporter 28 by a pin 31 in such manner that the bearing body 29 can oscillate about the pin 31, while the runner wheels 15, provided at both ends of the rotary shaft 13, can vertically oscillate about the pin 31.

As shown in FIG. 5, the rotary shaft 13 is coupled with a motor 32 provided on the left side of the base frame 11 through pulleys and belts.

A motor base 33 supporting the motor 32 is provided on an auxiliary base 34, shown only in FIG. 4, so as to be movable in the same direction as the carriage 18 of FIG. 5, said motor base 33 being provided with a nut 36 engaging with male threads 35, shown only in FIG. 4, on the center shaft 26 so that the motor base 33 and the carriage 18 of FIG. 5 are synchronized with each other. The rotary shaft 13 of FIG. 4 can be driven continuously by the motor 32 even when the spacing between the runner wheels 15 is varied. Rotation can be imparted to the molding box 2, as shown in FIG. 5, by driving the runner wheels 15 by the motor 32.

On the base frame 11 there is provided a vibration generating unit 41 for imparting vertical vibrations to the molding box 2 supported by the runner wheels 15 through the rotary shaft 13. As shown in FIGS. 4 and 6, the vibration generating unit 41 is connected with the motor base 33 through a connecting rod 42 and provided on a movable table 43 integrally with the motor base 33 on the base frame 11 so as to move also integrally with the rotary shaft 13 which shifts for the space control.

The vibration generating unit 41 comprises a roller 44 secured at each end of the rotary shaft 13 inside of the carriage 18 of FIG. 6, an oscillatable lever 46 with one end thereof pivoted on the movable table 43 by a pin 45 directly under the roller 44, a first rotor 47 pivoted on the oscillatable lever 46 so as to support the roller 44, a cam shaft 49 pivoted on the movable table 43 so as to be located directly under a second rotor 48 pivoted on the other end of the oscillatable lever 46, a cam 50 secured to the cam shaft 49 to support the second rotor 48, and a motor 51 mounted on the motor base 33 so as to drive the cam shaft 49. It imparts shocks to the molding box 2 supported between the runner wheels 14, 15 by rotating the cam 50 by means of the motor 51, shown only in FIGS. 4 and 5, while vertically moving the rotary shaft 13 through oscillation of the lever 46.

As shown only on the right-hand side of FIG. 3, a rail 52 is laid on the floor longitudinally with respect to the molding box 2 so as to be parallel with the axis of said molding box 2. A platform car 53 is provided on the rail 52 so as to be reciprocatable relative to the base frame 11, an elongated press roller 55 being rotatably mounted on the upper part of a support frame 54.

The press roller 55 is horizontally disposed with the ends thereof supported by bearings. The press roller 55 has a length sufficient to project beyond the opposite end of the molding box 2 after penetrating therethrough when the platform car 53 comes closest to the base frame 11. The forward end of the press roller 55 is adapted to be supported by a bearing 57 provided on support table 56 after penetrating through the molding box 2.

The press roller 55 is driven by a motor 58 provided on the platform car 53 in the same direction with the molding box 2 in such a manner that its outer peripheral velocity is higher than the inner peripheral velocity of the inner surface of the pipe 1 formed inside the molding box 2, while pressing the concrete in the molding box.

On the floor on the right-hand side of the molding box 2 in FIG. 3, there is provided a concrete supply unit 61 for supplying stiff-consistency concrete into the molding box 2.

The concrete supply unit 61 comprises a frame 62 erected astride the platform car 53 movable on the rail 52, a belt conveyor 63 horizontally supported so as to be in parallel with the axis of the molding box 2, a hopper 64 provided over the conveyor 63, and a feed unit 65 located between the hopper 64 and the conveyor 63 for supplying concrete uniformly onto the conveyor 63. The conveyor 63, supported by rollers mounted on the frame 62, is adapted to be longitudinally movable so as to be capable of entering into the upper part of the molding box 2. The conveyor 63 is adapted to reciprocate in conformity with the reversible rotation of the motor 66.

The supply of concrete into the molding box 2 by the concrete supply unit 61 is automatically controlled in conformity with the compaction by the press roller 55 to obtain a pipe having a uniform strength over the whole length thereof.

The control of the supply unit 61 during the supply of concrete is effected as follows. The variation in resistance due to compaction in the location of the supply of concrete is electrically detected through the press roller and the conveyor 63 is sequentially moved by a predetermined distance.

In operation, as seen in FIG. 5 the spacing between the runner wheels 14, 15 is determined according to the diameter of the molding box 2 to be used. The spacing can be adjusted by bringing the runner wheels 14, 15 toward and away from each other by means of the motor 27. The vibration generating unit 41 and the motors 32, 51 move integrally with one of the runner wheels 15.

The molding box 2 incorporating a wire mesh basket is placed on the runner wheels 14, 15, the belt conveyor 63 being brought into the molding box 2 by starting the motor 66 of FIG. 3.

Rotation is imparted in FIG. 5 to the molding box 2 supported by the runner wheels 15 by actuating the motor 32, while a predetermined amount of concrete (preliminarily supplied into the hopper 64, e.g. stiff-consistency concrete having a water content below 28%) is uniformly supplied by the conveyor 63 into the molding box 2 over the whole length thereof.

The initial amount of supply of concrete into the molding box 2 is preferably up to about 95% of the whole amount of supply, the concrete being roughly molded on the inner periphery of the molding box 2 by the centrifugal force.

When the predetermined amount of concrete has been supplied, the vibration generating unit 41 is actuated by starting the motor 51 while the molding box 2 is rotated.

The cam 50 of FIG. 6 is rotated by the motor 51 of FIG. 5 to vertically oscillate the oscillatable lever 46. Through the rotor 47 of FIG. 6, mounted on the oscillatable lever 46, the rotary shaft 13 is vertically oscillated about the pin 31 of the bearing 20, thereby imparting vertical vibrations to the molding box 2 of FIG. 5, as it is supported by the runner wheels 15.

Figure 1:
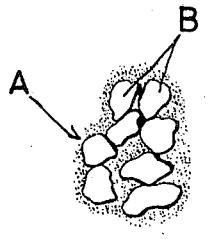
FIG. 1 is a view showing how aggregates exist with the conventional concrete pipe.
Figure 2:
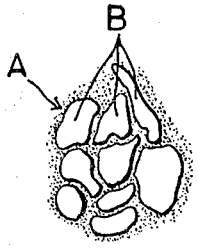
FIG. 2 is a similar view with the concrete pipe produced according to the present invention.

The molding box 2 receives vertical shocks while rotating. Thus, in the centrifugally molded concrete (A) shown in FIG. 2, the components of the ballast (B) disperse with cement and sand wedging therebetween.

In effect, when vibrations are imparted to the molding box 2 while it is rotating, the components of the ballast (B) in the concrete (A) are dispersed. Thus, the state in which cement and sand are interposed between the components of the ballast (B) is obtainable.

After imparting rotation and vibrations to the molding box 2 for a predetermined period of time, the vibration generating unit 41 of FIGS. 4–6 is stopped by cutting the power supply. The platform car 53 of FIG. 3 is driven toward the molding box 2 to insert the press roller 55 into the molding box 2. The press roller 55 is then rotated by the motor 58 with the forward end thereof supported by the bearing 57.

The conveyor 63 is again caused to enter the molding box 2 to supply the residual concrete into the molding box 2 at spacings. Thus, the pipe 1 is formed through uniform compaction of concrete over the whole length inside the molding box 2.

As is apparent from the foregoing, the invention has the following advantages.

(1) Since rotation and shocks are simultaneously imparted to the molding box 2 filled with concrete (A) to produce a pipe 1, the ballast (B) in the concrete (A) is dispersed, thereby permitting cement and sand to be interposed between the components of the ballast (B). Thus, the components of the ballast (B) are securely bonded to each other through the cement and sand interposed therebetween, thereby greatly increasing the strength of concrete (A).

(2) The cement and sand interposed between the components of the ballast (B) serve as shock absorbers, thereby making it possible to produce concrete pipes 1 having a particularly high resistance to an external force. A pipe 1 was produced with stiff-consistency concrete (A) having the same aggregates and cement as used for the production of a Hume concrete pipe, and the pipe 1 thus produced was found to have strength 50% higher than that of ordinary Hume concrete pipes.

(3) The molding box 2 can be supported irrespective of the variation in its diameter because the space between the runner wheel 15 can be adjusted. Not only the range of use is wide but also smooth rotation can be imparted to the molding box 2 by maintaining the molding box 2 and the runner wheels 15 in a fixed inter-relation.

What is claimed is:

1. An apparatus for producing concrete pipes, said apparatus comprising:

a molding box for molding concrete into a pipe, said molding box having a smooth outer surface, a single pair of runner wheels, arranged at each side of said molding box for supporting said molding box horizontally, each of said single pair of runner wheels having a smooth outer surface, at least one of said single pair of runner wheels being vertically movable, drive means for driving the one of said single pair of runner wheels to impart smooth relation to said molding box, vibration generating means for moving at least one of said single pair of runner wheels having a smooth outer surface vertically to impart vibrations to the smooth outer surface of said molding box, and said single pair of runner wheels being adapted so that the distance therebetween can be adjusted according to the diameter of said molding box.

2. An apparatus for producing concrete pipes, said apparatus comprising:

a molding box for molding concrete into a pipe, a pair of runner wheels arranged at each side of said molding box for supporting said molding box horizontally, at least one of said runner wheels being vertically movable, drive means for driving said runner wheels to impart rotation to said molding box, a pair of rotary shafts passing one each respectively through centers of the pair of runner wheels and being driven by the drive means, a roller secured to each end of one of the pair of rotary shafts, a lever provided beneath the roller and pivoted at one end thereof and having a rotor at the other free end thereof, a rotor pivoted on the lever half way along the length of the lever to support the roller, a cam mechanism provided under the free end of the lever and adapted to impart pivotal movement to the lever, and thus a vertical movement to said one of the runner wheels, and a drive means for driving the cam mechanism.

* * * * *